United States Patent [19]

Jammet

[11] 4,353,137

[45] Oct. 12, 1982

[54] TOILET SEAT

[76] Inventor: Pierre Jammet, 16 Bd. du Parc, 92200 Neuilly-sur-Seine, France

[21] Appl. No.: 197,532

[22] Filed: Oct. 16, 1980

[30] Foreign Application Priority Data

Oct. 26, 1979 [FR] France ..... 79 26587

[51] Int. Cl.[3] ..... A47K 13/00

[52] U.S. Cl. ..... 4/237; 4/234

[58] Field of Search ..... 4/234–240; 16/149, 158, 159; 108/152; 297/337

[56] References Cited

U.S. PATENT DOCUMENTS

| | | | |
|---|---|---|---|
| 1,194,392 | 8/1916 | Judd | 4/237 X |
| 1,221,060 | 4/1917 | Judd | 4/237 |
| 1,697,663 | 1/1929 | Schulte | 4/237 |
| 2,696,619 | 12/1954 | Ring | 4/237 X |
| 3,153,248 | 10/1964 | Miller | 4/239 |
| 3,183,036 | 5/1965 | Hill | 297/337 X |
| 3,261,030 | 7/1966 | Blem | 4/239 |
| 3,587,119 | 6/1971 | Gerena-Freses | 4/242 |
| 3,653,077 | 4/1972 | Warnberg | 4/236 |
| 3,752,088 | 8/1973 | Kapnek | 108/152 |
| 3,805,327 | 4/1974 | Walker | 16/159 |
| 3,808,612 | 5/1974 | Boyle et al. | 4/239 |

FOREIGN PATENT DOCUMENTS

| | | | |
|---|---|---|---|
| 451440 | 10/1927 | Fed. Rep. of Germany | 4/236 |
| 1180551 | 2/1970 | United Kingdom | 4/237 |
| 1190753 | 5/1970 | United Kingdom | 4/237 |

*Primary Examiner*—Henry K. Artis

*Attorney, Agent, or Firm*—Young & Thompson

[57] ABSTRACT

A seat for a toilet pan comprises a disposable and interchangeable annular member arranged to be used in place of the customary flap-seat. The member has means for positioning it relative to the holes provided, in customary manner, in the rear top area of the pan. The positioning means are arranged such that the member can be rapidly and positioned simply and removed.

5 Claims, 8 Drawing Figures

TOILET SEAT

BACKGROUND OF THE INVENTION

In general, a toilet seat is permanently attached to the toilet pan by means of a joint so as to form a flap-seat which can move between a lowered position on the pan, for use, and a raised position which permits cleaning.

However, cleaning of the seat is rendered difficult in the region of the seat joint.

In order to improve the hygiene conditions, it has already been proposed to provide the user with individual covering sheets which match the shape of the seat. They make it possible to isolate the user from any direct contact with the seat and are thrown away after use.

A solution of this type doubtless reassures the user, but nevertheless does not eliminate the microbes and viruses which reside on the seat.

SUMMARY OF THE INVENTION

The present invention relates to a toilet seat in particular for hotels, hospitals and other public places, which is itself easily interchangeable and which thus absolutely prevents a new user from sitting on a toilet which is contaminated, even underneath the seat, by microbes and viruses against which he may not be immunised.

According to the invention, a toilet seat is provided which has the following features:

(1) the traditional flap-seat is dispensed with and a disposable and frequently interchangeable member is used in its place;

(2) the traditional holes in the pan are utilised for positioning this member; and (3) means for positioning this member are rendered immediately active by simple insertion and are rendered immediately inactive by simple removal.

The first feature ensures that a high degree of hygiene is provided inasmuch as the microbial germs no longer reside on the flap-seat, because the latter is dispensed with, while the pan (made of porcelain) can be cleaned efficiently.

The second feature makes it possible to simplify the fitting conditions because the holes in the pan, which originate from construction, are used.

The third feature makes the member easy and rapid to position and remove by a member of the hotel or hospital staff, who does not need to be equipped with tools.

The hygiene appliances in hotels or hospitals are thus kept in a perfect state of cleanliness. It is necessary only for the chambermaid to change the seat at the same time as the paper and the soap.

In a preferred embodiment, the seat is made of a light, asepticised and thermally insulating material, for example a bulky plastics material, such as expanded polystyrene, or it can be formed by an inflatable cushion. Preferably, the seat is packed before use in a tamper-proof aseptic envelope.

In one embodiment, the positioning means for the seat consist of projecting studs which are integral with the seat and are arranged to be inserted in holes which are provided in the customary manner, by construction, in the rear top area of the pan, the said holes constituting complementary members.

In this arrangement, the seat sits flat in the standard holes in the toilet pan and its material prevents the enamel of the pan from being damaged. Its immediate positioning permits easy installation, without the use of tools, by any employee and does not necessitate the intervention of a workman. The user is assured of being the first user by the plastics envelope which guarantees the sterility of the seat. The user has only to remove this envelope and throw it into the wastepaper basket before using the seat.

In a further embodiment, the positioning means for the seat consist of holes which extend longitudinally in the seat and are arranged to be inserted over pegs which are mounted so as to pivot on a cross-piece fixed to the rear upper area of the pan, the said pegs constituting the said complementary members.

As in the first embodiment, the seat can thus be positioned immediately, but, in this case, the pan is advantageously fitted with a lid, which is desirable in luxury hotels.

BRIEF DESCRIPTION OF THE DRAWINGS

Embodiments of the invention will hereinafter be described, by way of example, with reference to the accompanying drawings, in which.

DESCRIPTION OF THE PREFERRED EMBODIMENTS

Figure 1:
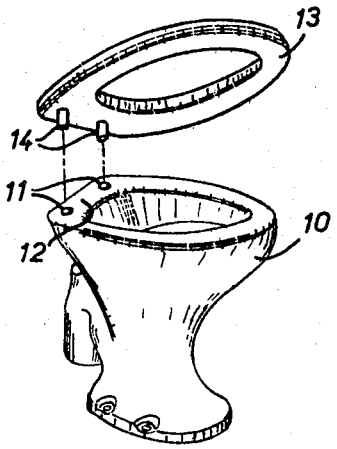
FIG. 1 is an exploded perspective view of a toilet pan and of a toilet seat according to the invention.
Figure 2:
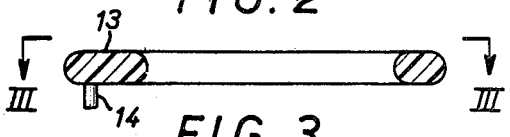
FIG. 2 shows a longitudinal section of the toilet seat of FIG. 1 taken along the line II—II of FIG. 3.
Figure 3:
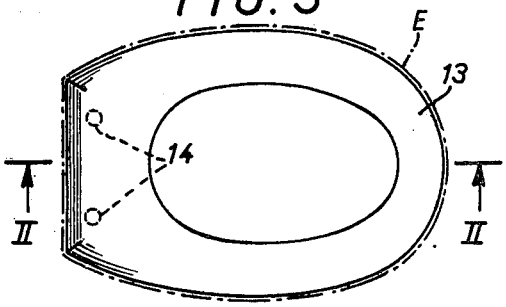
FIG. 3 is a top plan view of the toilet seat taken in the direction of the arrows III—III of FIG. 2.
Figure 4:
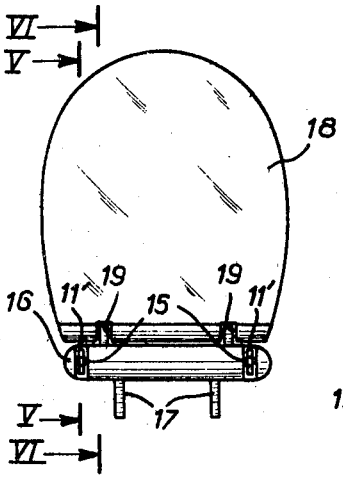
FIG. 4 shows an elevation of an alternative embodiment of a toilet seat including a lid, taken in the direction of the arrows IV—IV of FIG. 5.
Figure 5:
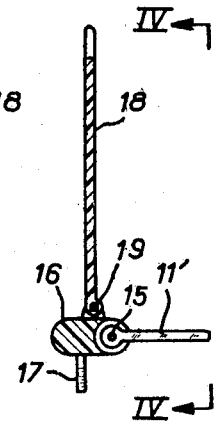
FIGS. 5 and 6 show longitudinal sections of the embodiment of FIG. 4 taken respectively along the line V—V and along the line VI—VI of FIG. 4.
Figure 6:
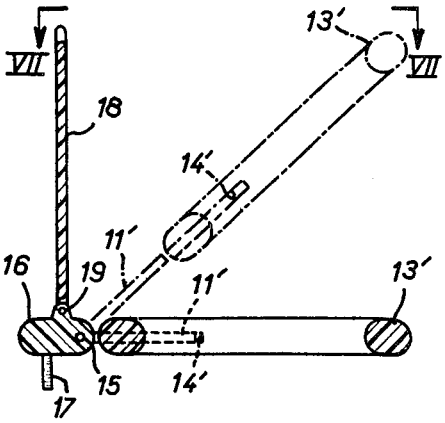
Figure 7:
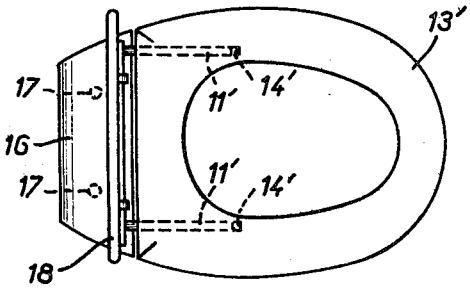
FIG. 7 is a plan view taken in the direction of the arrows VII—VII of FIG. 6.
Figure 8:
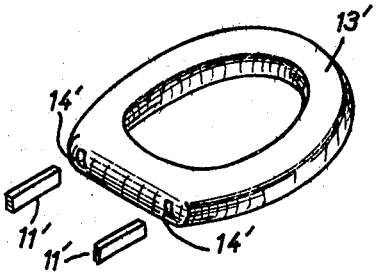
FIG. 8 is a perspective view of the seat of FIGS. 4 to 7.

Reference will first be made to FIGS. 1 to 3, which show, by way of a non-limiting example, the application of the present invention to a standard toilet pan.

FIG. 1 shows the toilet pan 10, which possesses, in the customary manner, two holes 11 provided, by construction, in its rear top area 12.

In accordance with the invention, a seat for the pan 10 consists of a disposable and frequently interchangeable annular member 13. The member 13 is designed to be virtually undeformable and is made of a bulky, light, asepticised and thermally insulating plastics material, such as expanded polystyrene, which offers every assurance because it is accepted as packaging in the food industry. Alternately, the seat can advantageously consist of an inflatable cushion, for example having an envelope made of a material of the rubber type or of plastics material or of impermeable gauze. This cushion is preferably stored deflated, and hence in a form having a low bulk, and can be inflated immediately by releasing a suitably precharged compressed-air pellet. The seat 13 is advantageously packed before use in a tamper-proof aseptic envelope E (FIG. 3).

The interchangeable seat 13 comprises positioning members 14. In the example shown in FIGS. 1 to 3, these members consist of projecting studs 14 integral with the seat 13. These studs 14 are designed to be immediately inserted in the holes 11 in the pan 10.

It will be appreciated that the studs 14 constitute positioning members which can immediately be inserted and removed and which are designed to co-operate with the holes 11, which themselves constitute complementary members associated with the pan 10.

A seat of this type can be used without a lid, in particular in hotels and in hospitals (for epidemics) and other public places, and makes it possible to prevent a new user from sitting on a toilet contaminated by microbes or viruses against which he may not be immunised. It will be noted that the seat 13 makes it possible to avoid any permanent attachment to the pan 10 and that this pan can thus be easily maintained in a perfect state of cleanliness, using common cleaning products.

The replacement of a seat by a new seat is effected immediately in a convenient manner, without requiring any fittings. The new user is assured of being the first user of the seat, by virtue of its plastic envelope which guarantees its sterility, and the user has only to remove this envelope before using the seat.

It will moreover be noted that, by virtue of the material of which the seat 13 is made, there is no risk that the latter will damage the enamel of the pan 10.

Reference will now be made to FIGS. 4 to 8, which show a further embodiment provided with a lid. In this embodiment, the seat, designated by 13' is analogous to the seat 13 which was described with reference to FIGS. 1 to 3, and again possesses positioning members 14' which can be immediately inserted and removed and which are designed to cooperate with complementary members 11' associated with the pan.

However, in this case, the members for positioning the seat 13' consist of holes 14' provided longitudinally in the seat, whilst the complementary members associated with the pan consist of pegs 11'. The latter are mounted so as to pivot, at 15, on a cross-piece 16 which is fixed to the rear top area 12 of the pan by means of screws 17, which are inserted in the holes 11 and receive locking nuts.

In the example shown in FIGS. 4 to 8, the cross-piece 16 also receives a lid 18 mounted so as to pivot, at 19, on this cross-piece.

As in the preceding example, the seat 13' is interchangeable. To take it off, it suffices to remove it immediately from the pegs 11', and to replace it, it suffices to insert the holes 14' in the new seat over the pegs 11'.

As previously, the interchangeable seat 13' offers every assurance of sterility and permits immediate positioning and easy maintenance.

Of course, the invention is not limited to the embodiments which have been described and shown, but encompasses all modified embodiments within the scope of the claims. The term annular member should be understood as meaning either a member forming a complete ring, as shown, or a member forming a partial ring, in the manner of a horseshoe.

I claim:

1. A seat for a toilet bowl which has two holes on its rear top area for fitting a flap-seat, the seat comprising a readily changeable annular seat member, a crosspiece having fastening members adapted to be received in the holes in the toilet bowl for securing said crosspiece relative to the toilet bowl, and pegs mounted on the crosspiece for pivotal movement between a raised inoperative position and a lowered operative position, said annular seat member having holes for receiving said pegs to permit said annular seat member to be readily inserted on said pegs or removed therefrom by simple relative displacement thereon.

2. A seat according to claim 1, and a pivoting lid on said crosspiece adapted to overlie the annular seat member in a lowered position.

3. A seat according to claim 1 or 2, said annular seat member being packed in a sealed aseptic envelope before use.

4. A seat according to claim 1, said annular seat member being of plastic foam.

5. A seat for a toilet bowl which has two holes on its rear top area for fitting a flap-seat, the seat comprising a readily changeable annular seat member, a crosspiece having fastening members adapted to be received in the holes in the toilet bowl for securing said crosspiece relative to the toilet bowl, and pegs permanently pivotally mounted on the crosspiece for vertical swinging movement between a raised inoperative position and a lowered operative position, said annular seat member having holes for receiving said pegs to permit said annular seat member to be readily inserted on said pegs or removed therefrom by simple relative displacement thereon, said pegs being substantially smooth and slidable readily into and out of said holes to facilitate replacement of said annular seat member.

* * * * *